US006559597B1

(12) United States Patent
Friedman

(10) Patent No.: US 6,559,597 B1
(45) Date of Patent: May 6, 2003

(54) ROTATING LIQUEFIED FILAMENT FOR HIGH EFFICIENCY INCANDESCENT LAMPS

(75) Inventor: Jerome D. Friedman, E. Topsham, VT (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 135 days.

(21) Appl. No.: 09/929,540

(22) Filed: Aug. 13, 2001

(51) Int. Cl.[7] ..... H01K 1/50

(52) U.S. Cl. ..... 313/578; 313/579; 313/315; 313/569

(58) Field of Search ..... 313/578, 579, 313/315, 569, 316, 115, 522

(56) References Cited

U.S. PATENT DOCUMENTS 4,499,398 A * 2/1985 Munroe ..... 313/113

4,866,340 A * 9/1989 Caems et al. ..... 313/579

* cited by examiner

*Primary Examiner*—Nimeshkumar D. Patel
*Assistant Examiner*—Anthony T. Perry
(74) *Attorney, Agent, or Firm*—William G. Auton

(57) ABSTRACT

An incandescent light, which uses a rotating, liquefied filament. The rotating filament consists of a thin layer of filament metal deposited on the interior convex surface of a refractory filament mount, which is inside the torus. The filament device is designed to rotate at a speed sufficient to prevent the metal from boiling off from, or breaking away from, the refractory surface of the filament mount as it rotates. The rotational speed of the torus will create a centrifugal force greater than the thermal forces, which would otherwise destroy the molecular integrity of the filament metal. The temperature of the deposited filament metal will exceed its normal melting point as it rotates. As it becomes hotter it will luminesce more in exponential proportion to the current applied to the rotating torus filament assembly.

5 Claims, 6 Drawing Sheets

ROTATING LIQUEFIED FILAMENT FOR HIGH EFFICIENCY INCANDESCENT LAMPS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to incandescent lighting systems and more specifically to a new design for a high efficiency liquid filament system with long life. Apart from the selection of filament materials, the design of the incandescent light has not evolved much since its initial development by Thomas Edison as shown in U.S. Pat. No. 223,898 issued Jan. 27, 1880.

SUMMARY OF THE INVENTION

The present invention includes a new design for an incandescent light that uses a rotating liquefied filament. The rotating filament consists of a thin layer of filament metal deposited on the interior surface of a filament mount. This mount is fitted within an evacuated quartz torus which is rotating about an axis within an evacuated glass envelope.

The filament device is designed to rotate at a speed sufficient to prevent the molten filament metal from boiling off from, or breaking away from, the surface of the filament mount as it rotates. The rotational speed of the torus will create a centrifugal force greater than the thermal forces, which would otherwise destroy the molecular integrity of the filament metal. To solve the possible problem of evaporation of the filament, this lamp could be built as currently manufactured halogen bulbs.

The temperature of the deposited filament metal will exceed its normal melting point as it rotates. As it becomes hotter it will luminesce more in exponential proportion to the current applied.

DESCRIPTION OF THE PREFERRED EMBODIMENT

Figure 1:
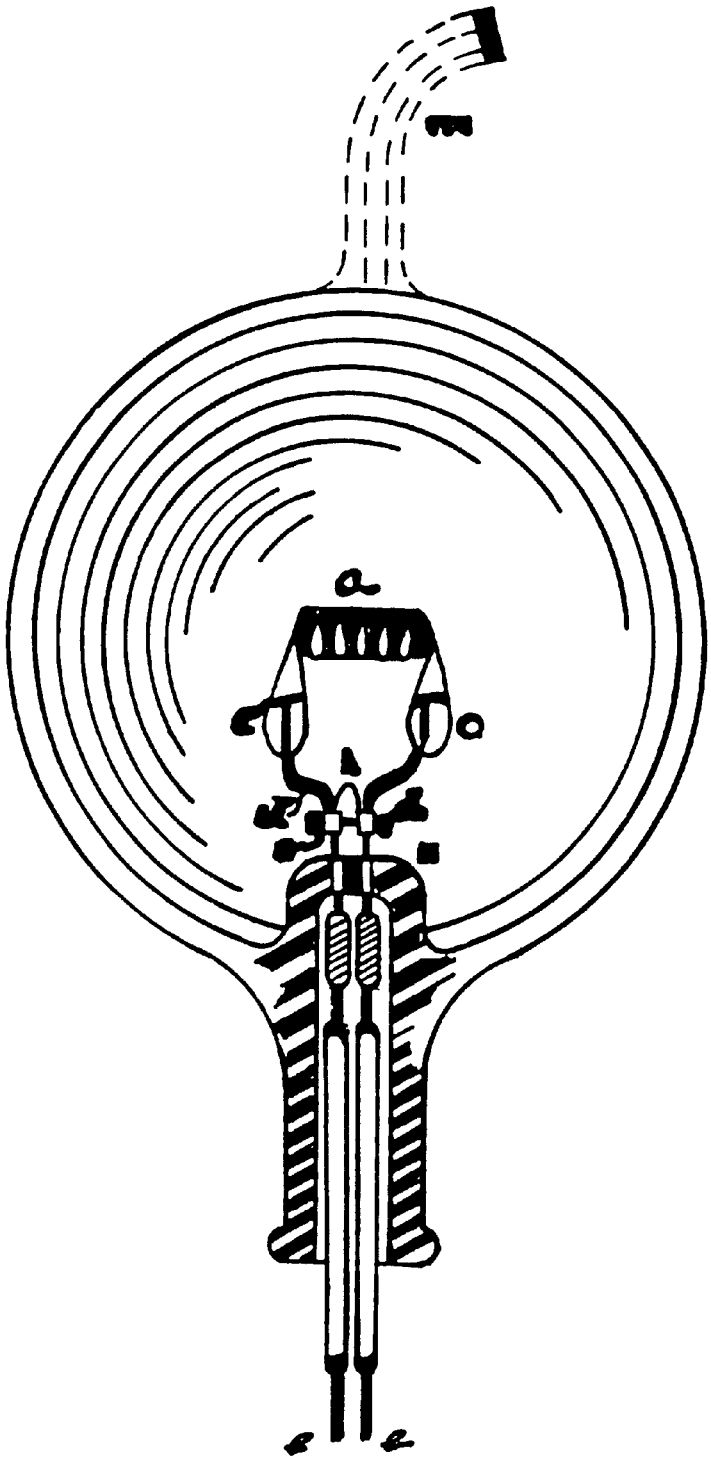
FIG. 1 PRIOR ART
FIG. 1 is an illustration of a prior art incandescent lamp.

The present invention includes a new design for an incandescent light that uses a rotating liquefied filament. The reader's attention is now directed towards FIG. 1, which is an illustration of the light bulb of the above-cited Edison patent. In this design, supports hold a coiled wire filament inside a glass bulb, which is a design in use today.

Figure 2:
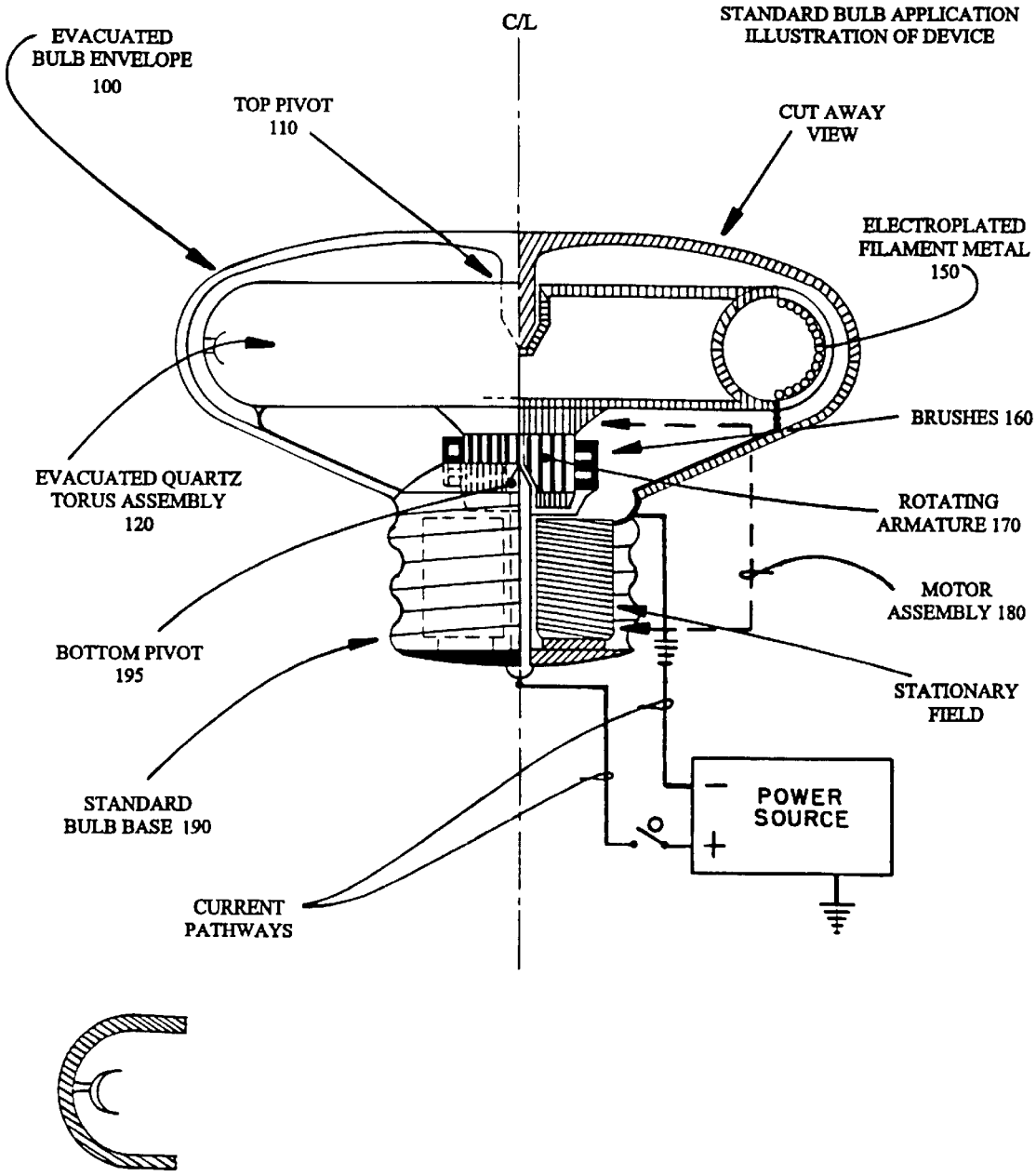
FIG. 2 is a view of the invention.

In contrast to the Edison system, the reader's attention is now directed towards FIG. 2, which is a side view of the present invention. In FIG. 2, the principles of the present invention are implemented in a standard bulb application consisting of: an evacuated bulb envelope 100, a top pivot 110, and evacuated quartz torus 120, refractory filament mount with filament metal 150, filament brushes 155, motor brushes 160, a rotating armature 170, a motor 180, a standard bulb base 190 with a bottom pivot 195.

The rotating filament consists of a thin layer of filament metal deposited on the interior concave surface of the refractory filament mount rotating within an evacuated glass envelope.

The filament device is designed to rotate at a speed sufficient to prevent the filament metal from boiling off from, or breaking away from, the surface of the refractory mount as it rotates. The rotational speed of the torus will create a centrifugal force greater than the thermal forces, which would otherwise destroy the molecular integrity of the filament metal.

The temperature of the deposited filament metal will exceed its normal melting point as it rotates. As it becomes hotter, it will luminesce more in exponential proportion to the current applied to the rotating filament.

Figure 3:
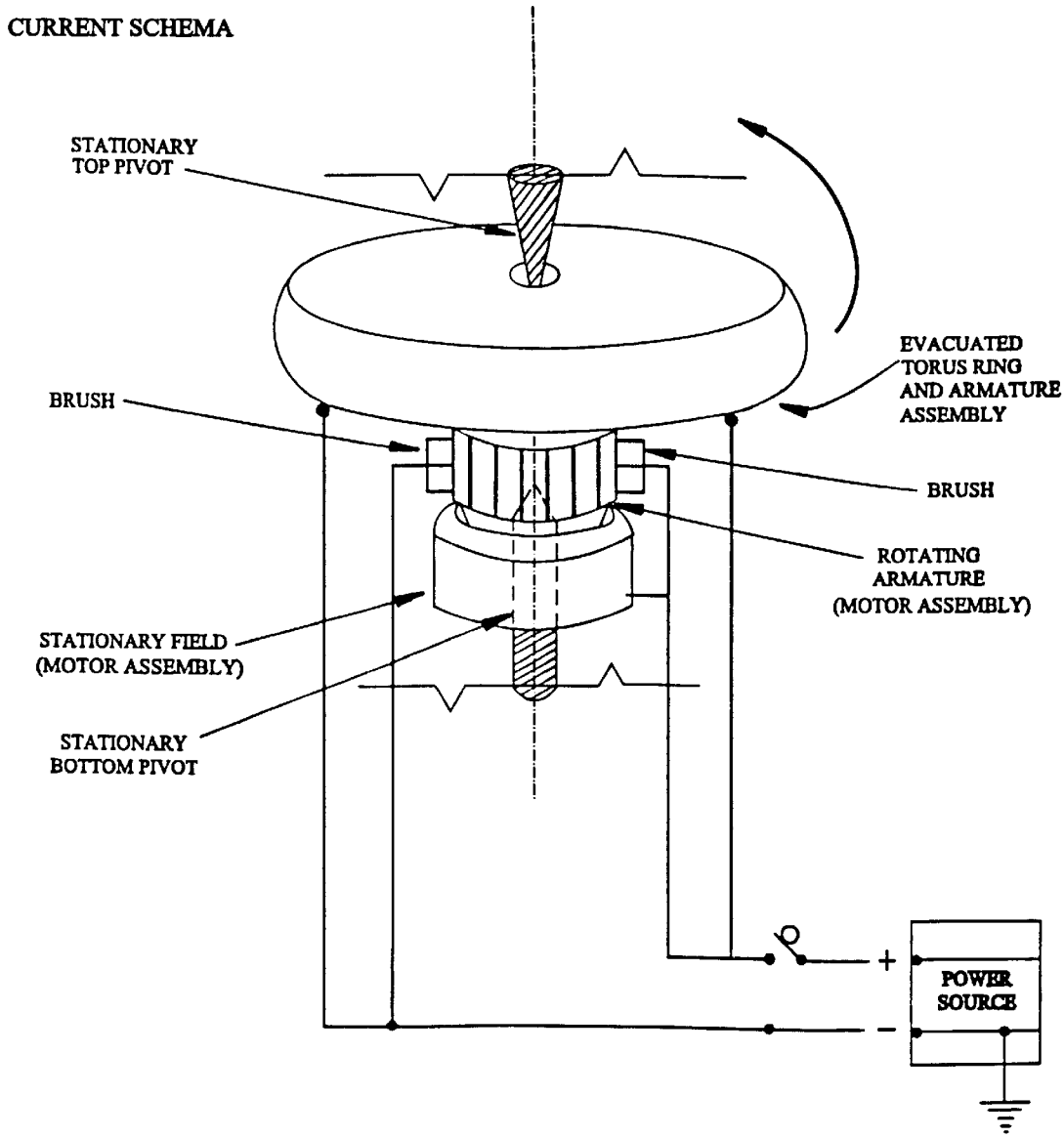
FIG. 3 is a view of the rotating filament elements.

FIG. 3 is a simplified representation of FIG. 2.

Figure 4:
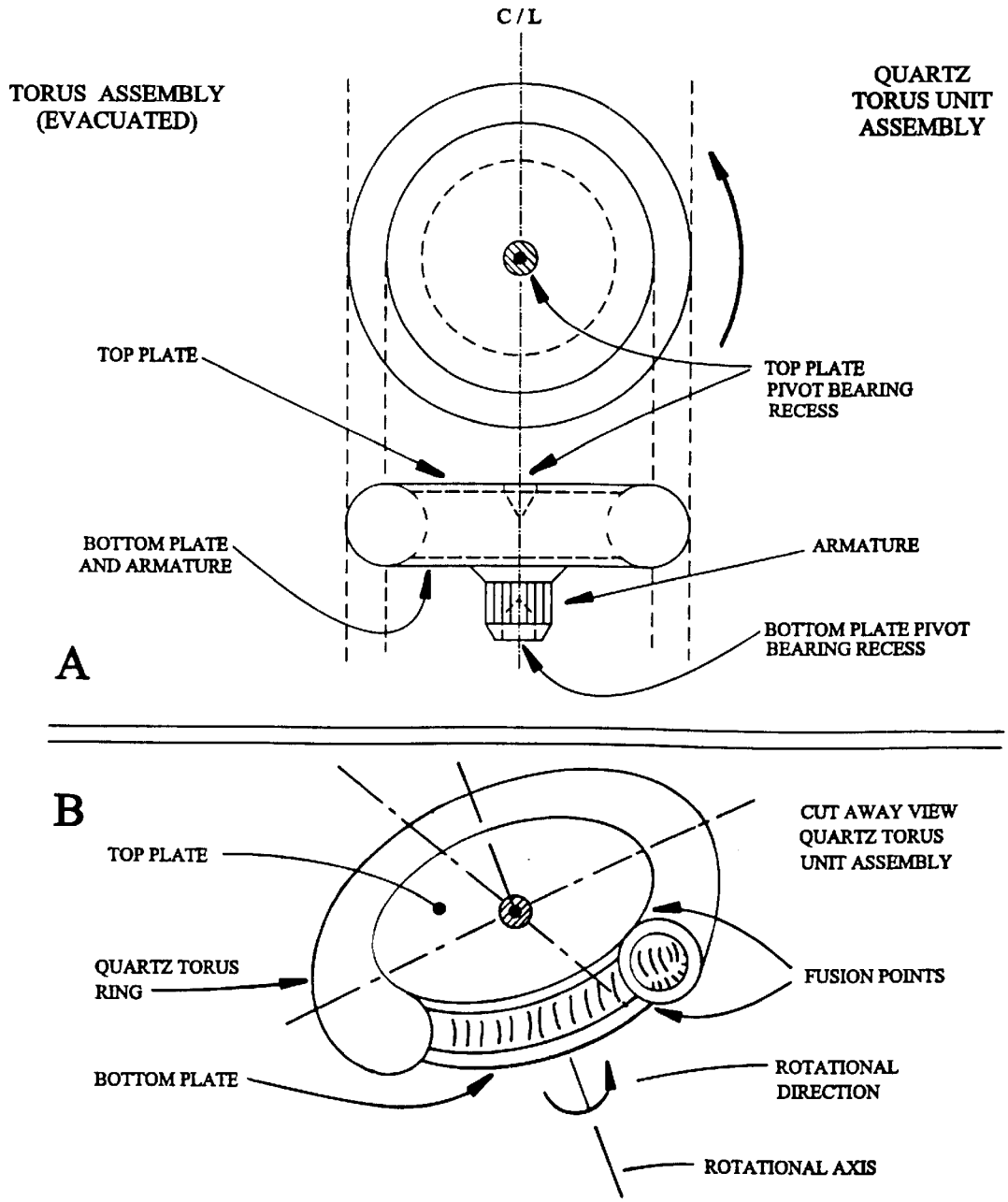
FIGS. 4*a*–4*b* are views of the torus ring assembly.

FIGS. 4*a*–4*b* illustrate more details of the rotating means of FIG. 2. FIG. 4*a* is a side view showing the stationary top pivot, brush, and stationary bottom pivot used. FIG. 4*a* also shows a plan view and side view of the torus assembly. FIG. 4*b* is an angled view.

In it's simplest and most utilitarian of applications this device could be used in incandescent bulbs. It could as well be utilized in specialty lamp applications such as incandescent lamps used in transportation applications, military applications, and beacons, or all high intensity lighting devices. Other uses would include heat sources such as the filament in the electron gun of a linear electron accelerator. This filament could be accommodated to any presently used power source without modification of present bulb or lamp configurations.

The efficiency standard of present filament materials in illumination devices is 15 lumens per watt of applied current and even when molten only gives 50 lumens per watt. This filament device would increase efficiency of lamps many fold and extend functional lamp life well beyond present use hours.

The rotation of the quartz torus and refractory filament mount is effected by any suitable motor incorporated in the bottom plate of the torus body.

The current to the filament metal might be supplied by induction or through slip rings (attached to filament contacts) and brush assembly similar to those used in automobile alternators.

Figure 5:
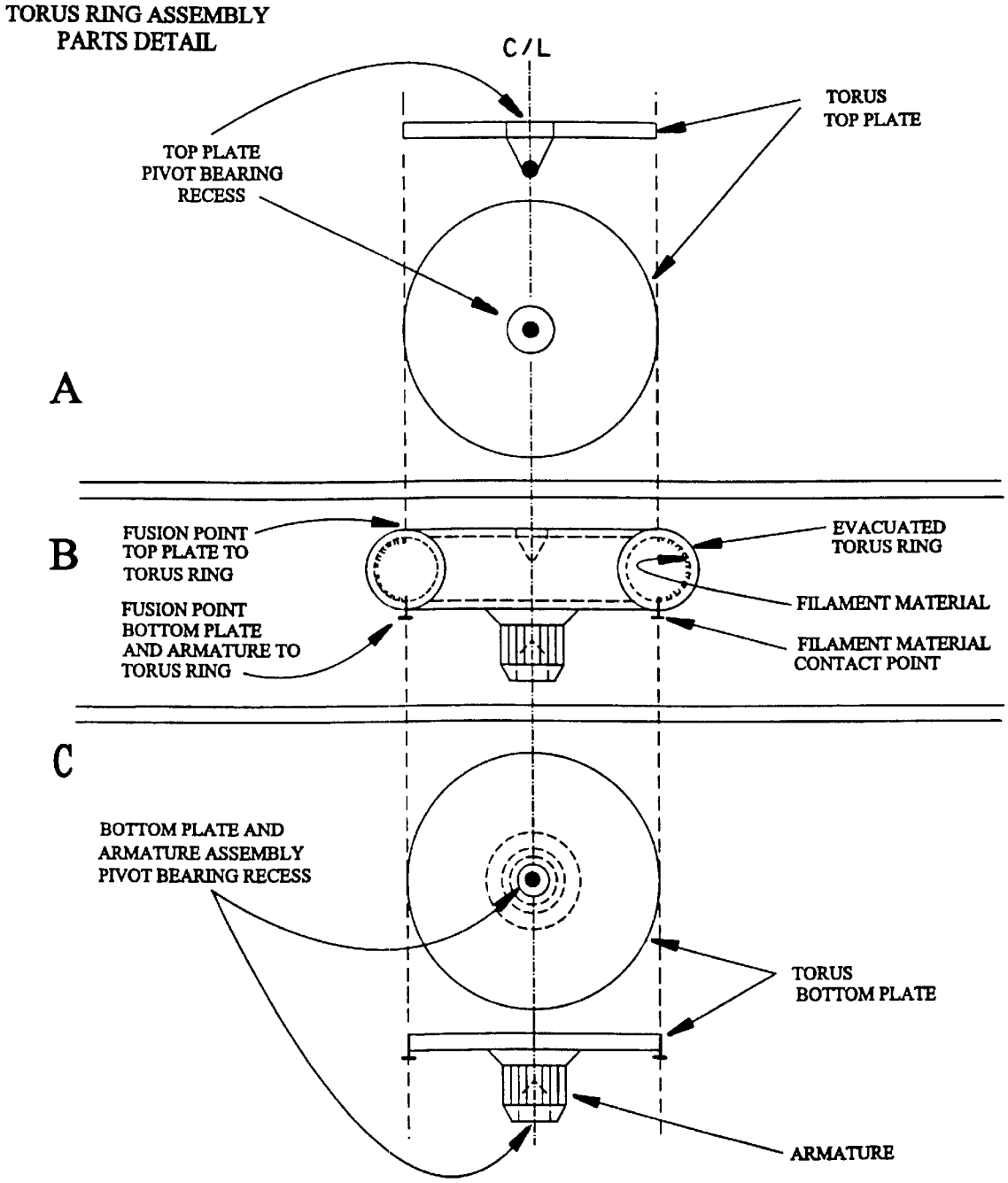
FIGS. 5*a*–5*c* are details of the torus ring assembly.

FIGS. 5*a*–5*c* show the parts detail of the torus ring assembly. The view of FIG. 5*a* shows the pivot bearing recess while the side view of FIG. 5*b* shows the evacuated torus ring with internal filament material and the filament material electrical contact point.

Figure 6:
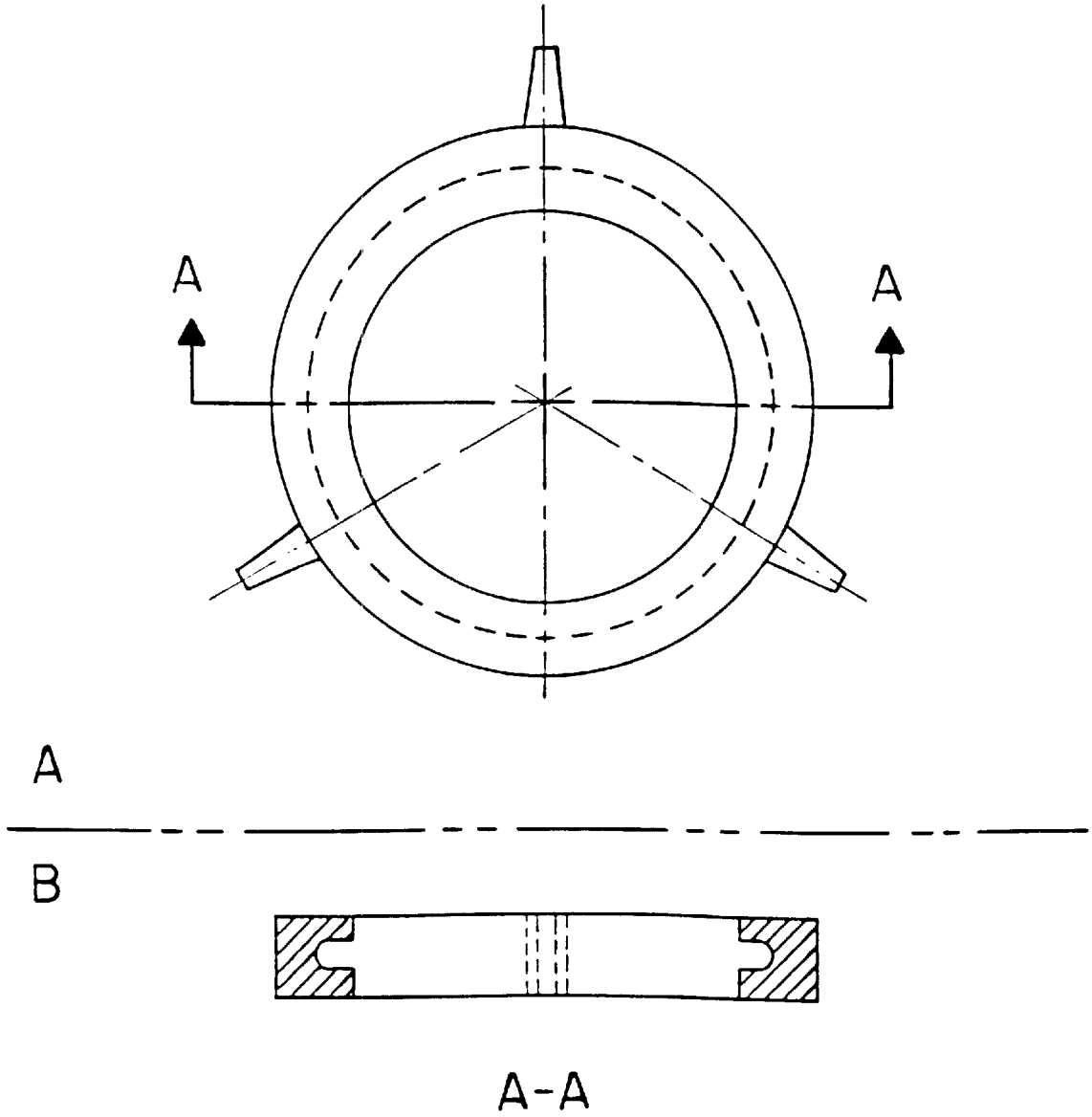
FIGS. 6*a*–6*b* are two views of the filament mount.

FIGS. 6*a* and 6*b* show the plan and its sectional side views of the filament mount.

This filament mount goes inside of torus. Filament fits into groove. Filament mount is as hot as filament. The filament mount purpose is to contain the softened or melted filament and isolate it thermally from the envelope.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An incandescent lamp assembly comprising:

a liquefied filament that emits light when supplied with electrical power; and an electrical connection means which can connect the liquefied filament to supply of electrical power.

2. An incandescent lamp assembly, as defined in claim 1, wherein said electrical connection means comprises a plug mount;

a rotating torus which contains said liquefied filament and electrically connects it to the plug mount so that when the plug mount is installed in an electrical socket, the liquefied filament is supplied with electrical power; and a means for rotating the rotating torus.

3. An incandescent lamp assembly, as defined in claim 2, wherein said rotating means comprises;

first and second pivot mounts which provide a top and bottom pivot about which the rotating torus rotates; and a motor assembly which rotates the rotating torus.

4. An incandescent lamp assembly, as defined in claim 3, wherein said rotating torus comprises a grooved refractory filament mount which in conjunction with the effect of the centrifugal force caused by the rotary motion will contain the filament even when sufficient electrical current is applied to raise the temperature of said filament to a point where it becomes liquefied and luminescence and efficiency is greatly increased.

5. An incandescent lamp assembly, as defined in claim 4, wherein liquefied filament is comprised of a liquid metal that is electrically conductive and which emits light when supplied with electrical power.

* * * * *